US012048353B2

(12) United States Patent
Cobb

(10) Patent No.: US 12,048,353 B2
(45) Date of Patent: Jul. 30, 2024

(54) FOOTWEAR WITH TRACTION LUGS BONDED TO A MIDSOLE

(71) Applicant: Wolverine Outdoors, Inc., Rockford, MI (US)

(72) Inventor: Ian M. Cobb, Rockford, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 76 days.

(21) Appl. No.: 17/468,979

(22) Filed: Sep. 8, 2021

(65) Prior Publication Data

US 2022/0125164 A1 Apr. 28, 2022

Related U.S. Application Data

(60) Provisional application No. 63/104,741, filed on Oct. 23, 2020.

(51) Int. Cl.
*A43C 15/16* (2006.01)

(52) U.S. Cl.
CPC ..... *A43C 15/161* (2013.01)

(58) Field of Classification Search
CPC ..... A43C 15/161; A43B 13/24; A43B 13/26
See application file for complete search history.

(56) References Cited

U.S. PATENT DOCUMENTS 3,738,026 A * 6/1973 Granger ..... A43B 5/001 36/134
4,035,934 A * 7/1977 Hrivnak ..... A43C 15/168 36/134
4,962,596 A * 10/1990 Dufour ..... A43B 5/001 36/67 A
6,782,642 B2 8/2004 Knoche et al.
2007/0277401 A1* 12/2007 Young-Chul ..... A43B 13/186 36/28
2011/0192056 A1* 8/2011 Geser ..... A43B 13/26 36/114

(Continued)

FOREIGN PATENT DOCUMENTS

DE 698156 C * 11/1940
GB 732255 A * 6/1955
GB 1092766 A * 11/1967

(Continued)

*Primary Examiner* — Megan E Lynch
(74) *Attorney, Agent, or Firm* — Warner Norcross + Judd LLP

(57) ABSTRACT

A footwear construction includes a sole assembly having a midsole of a first durometer and a plurality of separate, individually reactive lugs of a second, greater durometer bonded to the midsole. On soft terrain, the individual lugs can remain extended and can engage that terrain to provide grip and traction. On hard terrain, the individual lugs can independently compress into deformation regions of the midsole to enhance traction, so that the midsole also can optionally contact the terrain with portions of the lugs. The sole assembly can include a fabric embedded and encapsulated in the materials of the lugs and the midsole to mechanically bond the lugs to the midsole and impair delamination. The individual lugs can include caps extending into the midsole with voids filled with the midsole material to improve the lug securement. A related method of manufacture also is provided.

18 Claims, 6 Drawing Sheets

(56) References Cited

U.S. PATENT DOCUMENTS

| | | | | |
|---|---|---|---|---|
| 2015/0059207 | A1* | 3/2015 | Karlsson | A43C 15/08<br>36/67 B |
| 2019/0328081 | A1 | 10/2019 | Baghdadi et al. | |

FOREIGN PATENT DOCUMENTS

| | | | | | |
|---|---|---|---|---|---|
| GB | 2145322 | A | * | 3/1985 | A43B 5/001 |
| GB | 2420485 | A | * | 5/2006 | A43B 13/26 |
| WO | WO-03071893 | A1 | * | 9/2003 | A43C 15/161 |

* cited by examiner

FOOTWEAR WITH TRACTION LUGS BONDED TO A MIDSOLE

BACKGROUND OF THE INVENTION

The present invention relates to footwear, and more particularly to footwear including a sole assembly having a plurality of traction lugs independently bonded to a midsole to provide dynamic traction on soft and hard underfoot terrain.

A variety of different sole assemblies are used in footwear. Many sole assemblies include a midsole constructed from foam, and an underlying outsole, usually constructed from a sheet of rubber for durability and ease of assembly. The foam provides underfoot cushion, and the outsole provides traction. Many times, the outsole sheet includes multiple lugs integrally formed with the sheet in different locations for traction and wear resistance. The outsole rubber sheet and integral multiple lugs typically are constructed from a unitary, contiguous material. The sheet spans between the individual lugs so that the midsole is covered by the sheet. This can protect the midsole from damage, but also has some issues.

For example, the rubber sheet typically is heavy. Thus, all the material spanning between the individual lugs increases the overall weight of the footwear. For performance and hiking footwear, where every gram matters, this can impair the wearer's performance and prematurely tire the wearer and/or slow their pace. Further, with the sheet of material spanning between the individual lugs, the outsole is quite rigid. Thus, the individual lugs, projecting directly from the sheet, function as a large group, rather than as individual lugs. In turn, the individual lugs are prevented from reacting to and engaging underfoot surfaces, which can impair traction on the same. With the common outsole sheet construction, the sole assembly may be less flexible, and less able to conform to underfoot contours and terrain. As a result, the sole assembly frequently does not provide acceptable proprioceptive feedback to the user regarding the contours and terrain, which can be detrimental to the user's balance and movement.

The above conventional sole assemblies usually are unable to dynamically adapt to different terrains. While the sole assemblies react consistently on all terrains, this can impair overall traction on varying terrains. For example, on soft terrain, the lugs are static relative to the sheet, and typically sink into the terrain material, up to the sheet. The surfaces of the lugs and the sheet thus engage the ground and provide decent traction. On hard terrain, however, the individual lugs projecting from the sheet will engage the ground. Due to the rigidity of the sheet, the lugs also remain static relative to sheet, projecting from it, so the hard terrain does not contact the sheet. As a result, the overall contact of the sole assembly with the terrain is limited to the only surfaces of the lugs contacting the terrain. Without the additional sheet contact, the overall surface area contacting the terrain is significantly reduced, which can impair traction on that hard terrain.

With the above conventional sole assembly, a user will have to be mindful of the different traction characteristics of their footwear on different types of terrain. For acceptable performance, the user should be able to understand the underfoot feedback from the terrain, to determine whether it is hard or soft, and what type of traction is therefore available for their activity using that particular footwear and sole assembly. From there, the user can adjust their movements and reaction on and to the terrain accordingly. If the user is inexperienced, or unfamiliar with terrain types, the user can inadvertently overestimate the amount of traction available, which can be detrimental to movement, balance and performance.

Accordingly, there remains room for improvement in the construction of sole assemblies to improve traction and function on different types of terrain, and to reduce the overall weight of the footwear for improved performance.

SUMMARY OF THE INVENTION

A footwear construction includes a sole assembly having a midsole and multiple separate, individually reactive lugs bonded to the midsole. On soft terrain, the individual lugs can remain extended and can contact that terrain to provide grip and traction. On hard terrain, the individual lugs can dynamically, independently compress into deformation regions of the midsole, so that the midsole optionally can contact the terrain with portions of the lugs to enhance traction.

In one embodiment, the midsole can be constructed from a first material having a first durometer. The multiple lugs can be constructed from a second material different from the first material, and can have a second durometer greater than the first durometer. The lugs therefore can be harder and more durable than the midsole. The midsole, however, can be compliant and resilient so that the harder lugs can individually and separately compress upward and retract into that softer material of the midsole, acting similar to a piston going up into the midsole.

In another embodiment, the midsole can include a ground facing midsole lower surface and can define multiple lug recesses. Each lug recess can be defined in the midsole lower surface and can be bounded by a recess bottom and a recess boundary edge. Each lug can be disposed in a respective recess.

In still another embodiment, the midsole can include a deformation region above each lug recess. The deformation region can be of the same structure and material as the remainder of the midsole, but due to its location relative to a lug, can be configured to deform and/or be modified in shape, density or other characteristics so that the individual lug can be urged or can move upward and at least partially into the deformation region above it. As a result, when the lug retracts into the midsole deformation region, the midsole lower surface surrounding or adjacent the lug can come into contact or engage the ground or terrain underfoot.

In yet another embodiment, the sole assembly can include the multiple individual lugs. Those lugs can be disposed in respective ones of the lug recesses. Each outsole lug can project outward from the respective recess and/or below the midsole lower surface a first distance of optionally 0.1 mm to 20 mm, inclusive, 0.1 mm to 15 mm inclusive, 0.1 mm to 10 mm inclusive, 1 mm to 5 mm inclusive, or other distances respectively when the lugs are in an unloaded state, or in a soft traction mode. The lugs can retract to a second projecting distance less than the first distance when the lugs are in a hard traction mode, in which the lugs can individually retract upward into the deformation region.

In even another embodiment, the outsole lugs can each include a base plate and a lug body. The lug body can include a lug wall that transitions from the base plate downward to a lug ground contacting surface. The base plate can include a flange extending laterally outward from the lug wall. That flange can include a flange lower surface and a lug flange edge.

In a further embodiment, the base plate of each lug can be bonded to the midsole. In some cases, the base plate can include a contact wall that is mechanically and chemically bonded directly to the recess bottom of the recess of the midsole. The recess bottom and the contact wall can be joined at a midsole/lug interface that is located below the deformation region. When the individual lug is loaded, the interface, bottom and/or the contact wall can bend convexly upward into the deformation region.

In still a further embodiment, each individual outsole lug is operable in a soft traction mode and a hard traction mode, independent from other individual outsole lugs. In the soft traction mode, the lug can extend below the midsole lower surface a first distance, even when the sole assembly is placed under the load of the user on a soft terrain surface. This first distance allows the lug to extend enough to provide helpful and acceptable traction on the soft terrain, digging and biting into that terrain well. In the hard traction mode, when the sole assembly is under the load of the user, the lug compresses upward into the deformation region of the midsole so that the outsole lug extends below the midsole lower surface a second distance that is less than the first distance. In some cases, the second distance is such that the midsole lower surface can contact and engage the underfoot terrain simultaneously with the lugs. As a result, the midsole lower surface and lugs can provide a combined ground contact surface having a greater surface area than that of the lugs along. This can enhance traction on the hard terrain.

In yet a further embodiment, the lugs can be joined with the midsole to impair delamination therefrom. For example, each lug can include a cap joined with the base plate opposite the lug body. A void can be formed between the cap and the base plate. The midsole material can extend into and fill the void. That material in the void can better interlock the lug with the midsole material, and can provide mechanical bonding to secure the outsole lug to the midsole.

In even a further embodiment, the sole assembly can include a fabric embedded and encapsulated in the materials of the lugs and the midsole to mechanically bond the lugs to the midsole and impair delamination. The fabric can include adjacent strands with interstitial spaces between the adjacent strands. The fabric can be joined with the outsole lug so that the second material extends through the interstitial spaces coextensive with the lug. The second material can encapsulate respective ones of the adjacent strands coextensive with the outsole lug. The fabric can be joined with the midsole so that the first material extends through respective ones of the interstitial spaces coextensive with the midsole. The first material can encapsulate respective ones of the adjacent strands coextensive with the midsole.

In another, further embodiment, a method is provided including: placing in a mold individual and spaced apart outsole lugs, each outsole lug including a base plate facing upward into a mold cavity of the mold and a lug body, the lug body including a lug wall that transitions from the base plate downward to a lug ground contacting surface, the base plate including a contact wall and a lug perimeter flange extending laterally outward from the lug wall and including a flange lower surface and a lug flange edge; introducing into the mold cavity a midsole material that bonds to the contact wall of each of the lugs; curing the midsole material to form a midsole having a first durometer less than a second durometer of each of the lugs, which are commonly joined with the midsole and one another; and removing the midsole with the lugs joined therewith from the mold.

In still another, further embodiment, the method can include embedding a fabric in each of the lugs before the placing step, so that each of the lugs are commonly joined with the fabric, and the fabric is coextensive through multiple ones of the lugs.

In yet another, further embodiment, the method can include allowing the midsole material to encapsulate the fabric during the introducing step so that the midsole material bonds with the fabric and the lugs to enhance the securement of the lugs to the midsole.

The present footwear construction provides benefits in traction and weight savings that previously have not been achievable. The current sole assembly, with its individual, separate and independent outsole lugs can eliminate a heavy connecting sheet that connects the lugs. The lugs instead can be independently joined in an isolated manner to the midsole. The midsole can be constructed of a compliant and/or resilient and compressible material. The lugs can therefore react dynamically to different types of terrain. For example, the lugs can individually compress upward into and/or retract into the midsole when the lugs engage a hard terrain surface. The lugs, however, can remain extended to adequately engage an underfoot softer terrain to provide traction in it. The lugs and midsole can thus dynamically engage an underfoot terrain, providing the adequate amount of traction regardless of whether the terrain is soft or hard.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
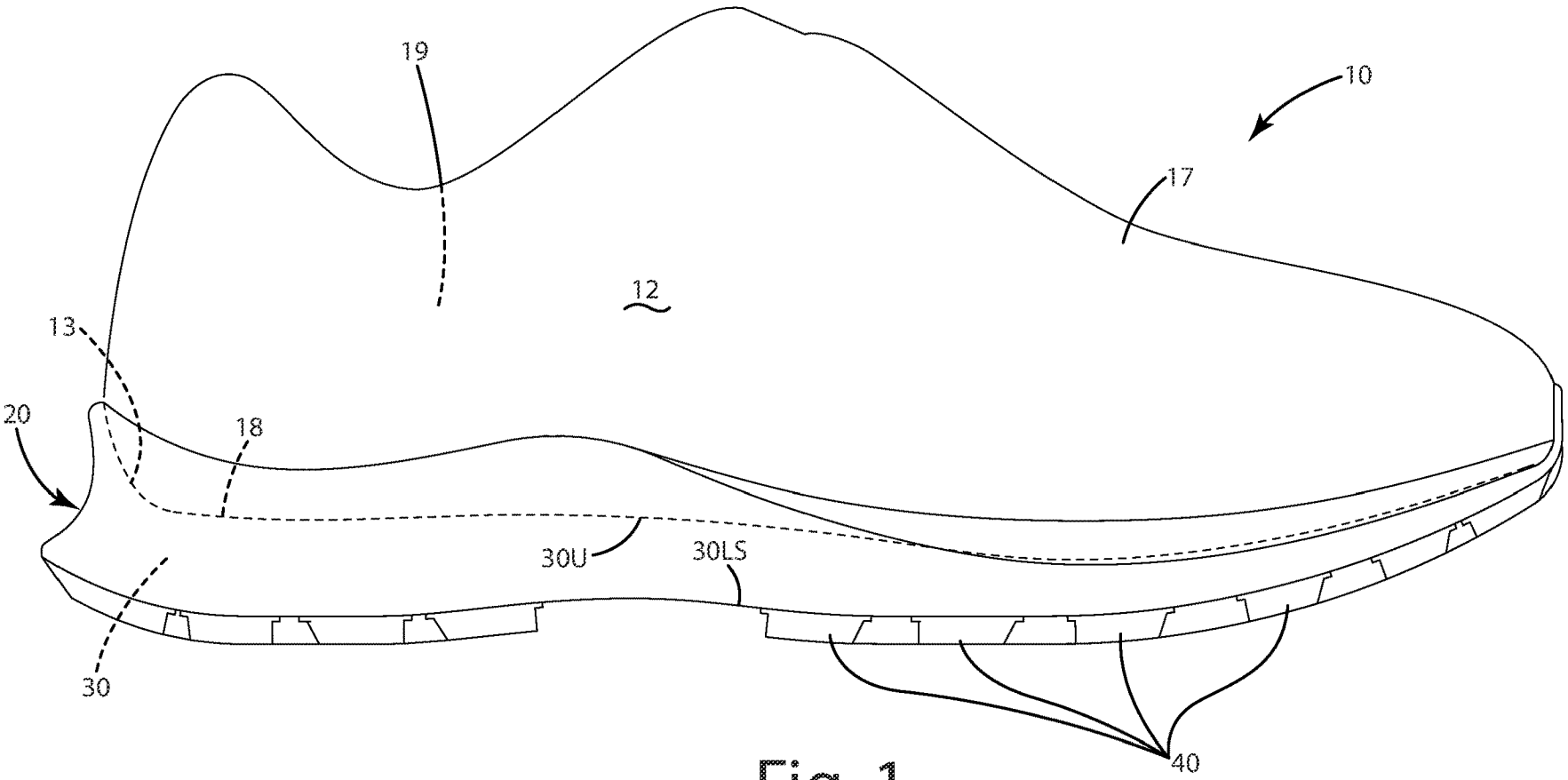
FIG. 1 is a side perspective view of footwear of a current embodiment including the sole assembly with multiple individual lugs attached to a midsole.
Figure 2:
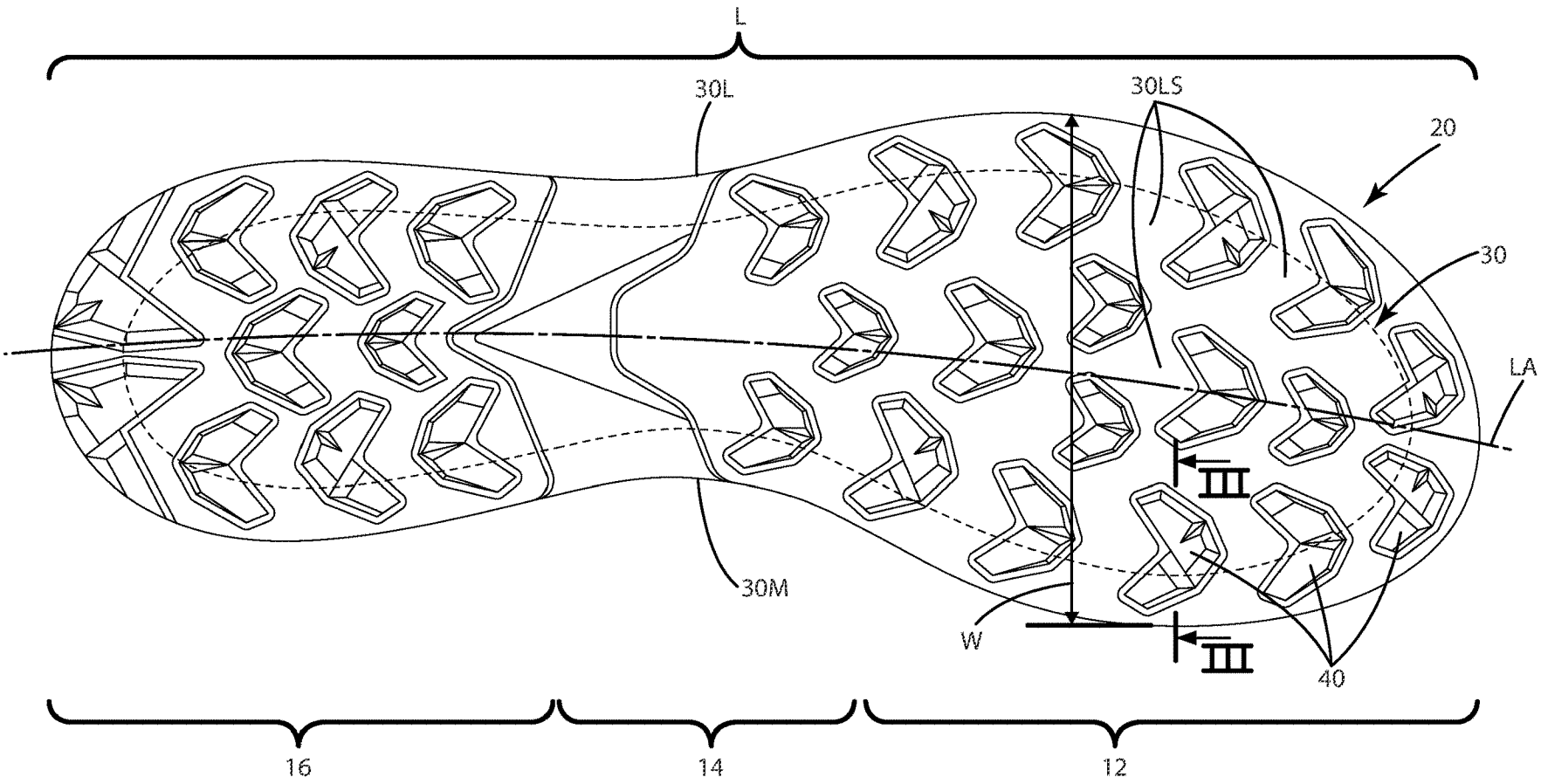
FIG. 2 is a bottom view of the multiple individual lugs independently and separately secured to the midsole.
Figure 3:
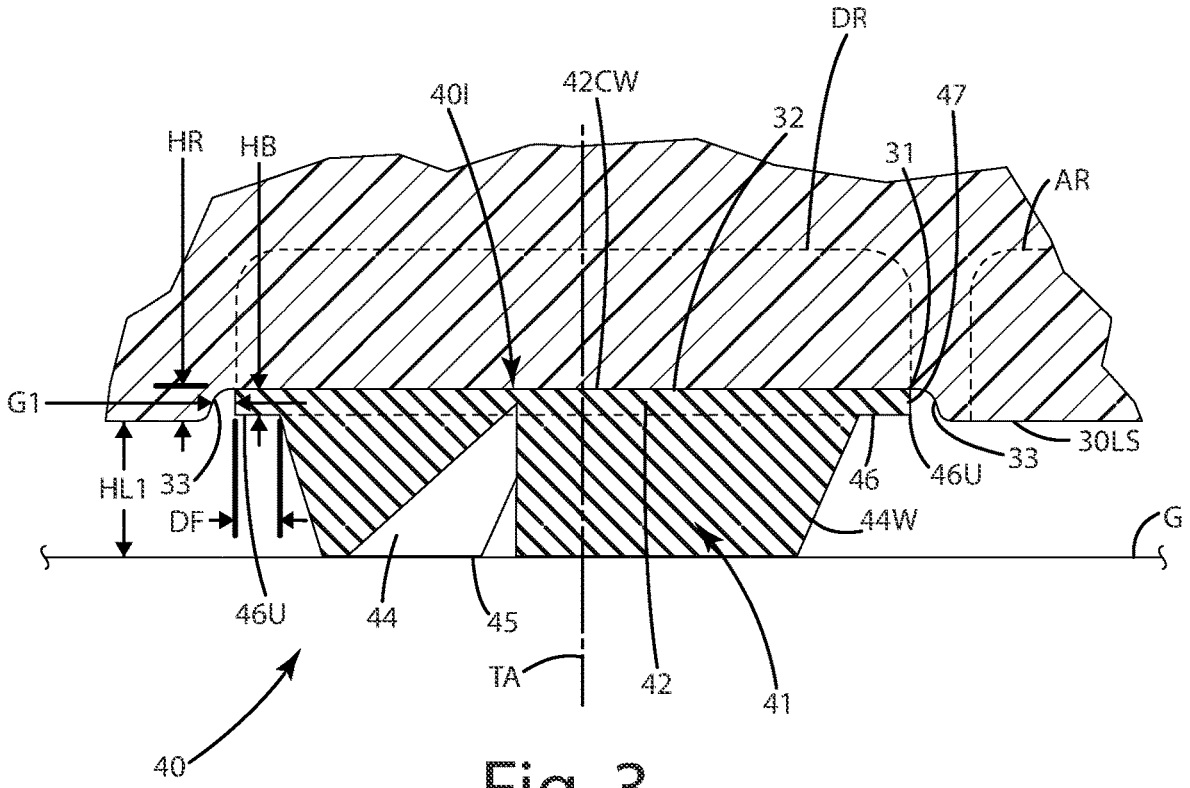
FIG. 3 is a section view of an individual lug and the midsole in an uncompressed soft traction mode.

A current embodiment of the footwear is illustrated in FIGS. 1-3 and generally designated 10. In this embodiment, the footwear includes a sole assembly 20 including a midsole 30 and multiple independent and separate lugs 40 spread out across the lower surface of the midsole with each separately and dynamically joined with the midsole in different positions. Although the current embodiment is illustrated in the context of a hiking or performance shoe, the sole assembly thereof can be incorporated into any type or style of footwear, including running shoes, trail shoes and boots, work boots, all-terrain shoes, athletic shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear.

With reference to FIGS. 1-4, the footwear 10 can include a sole assembly 20. The sole assembly 20 can include a midsole 30 and multiple independent lugs 40. More or fewer elements of the sole assembly 20 can be included in some embodiments. The components of the sole assembly can individually and/or collectively provide the article of footwear 10 with a number of attributes, such as energy return, pronation correction, supination correction, support, rigidity, flexibility, stability, cushioning, comfort, reduced weight, and/or other attributes. Generally, regardless of which components are present, the sole assembly 20 can form the bottommost portion of the footwear 10. The sole assembly 20 can include a side-to-side width W, a heel-to-toe longitudinal length L and a longitudinal axis LA, which can be shared with the sole assembly, midsole and outsole layer.

The footwear 10 can include a textile upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 17 can be constructed to improve the rigidity of the sole assembly 20. For example, the upper can be constructed from leather, plastic, canvas or other materials. The upper 17 can include one or more closure elements, including for example shoelaces (not shown). The upper 17 additionally includes an upper opening 19 for receiving the wearer's foot and a lower periphery 13 for attachment to the sole assembly 20.

A footbed (not shown) can be positioned within the void defined by the upper and can be non-stretchable and lightweight and joined to the upper to provide a void for receipt of the wearer's foot. The footbed can be constructed from a sheet of material, such as foam, EVA, polyurethane (PU), latex, gel or other materials, and by virtue of its compressibility, provide cushioning, and may also conform to the foot in order to provide comfort, support and stability. The lower peripheral allowance or edge of the upper can be stitched, cemented or otherwise fastened to the footbed around the perimeter of the footbed. The sole assembly 20 can be combined with any other type or style of upper construction capable of being suitably joined with it, for example, a Strobel construction. With a Strobel construction, a Strobel board or insole board or insole 18 can be joined with the lower peripheral allowance 13 of the upper to close the void 12 of the upper. The joining of the sole assembly/outsole and the upper can be accomplished using adhesives, cement, injection molding, pour molding or any other technique used to join an upper and sole assembly.

With reference to FIGS. 1-3, the sole assembly can include a midsole 30. The midsole 30 can include midsole upper surface 30U, a ground facing midsole lower surface 30LS, a midsole lateral sidewall 30L and a midsole medial sidewall 30M. Along the length L of the midsole, the transitions and the midsole upper surface can form a downward recess across the width W along different parts of the length of the midsole 30.

As shown, the midsole upper surface 30U can be joined to the Strobel board 18 and portions of the lower peripheral allowance 13 of the upper. The attachment can be via cement, adhesives, heat bonding, stitching, or other techniques and structures. The midsole lower surface 30LS can be contoured or flat depending on the footwear application and the intended interaction with an underfoot terrain G, which can be any surface, such as ground, hard terrain like concrete, pavement, rocks, rocky surfaces, hard clay, flooring, etc, and/or soft terrain, like soft ground, sand, soft clay, gravel, grass, tundra, forest floor, field dirt, etc.

As mentioned above, the midsole can include the midsole sidewalls 30M and 30L. These sidewalls can take on a variety of contours leading from the upper surface to the lower surface. In some cases, the sidewalls can be concave or convex. The midsole 30 can be constructed from a variety of materials, such as ethyl vinyl acetate (EVA), polyurethane (PU), latex, a gel, expanded thermoplastic polyurethane (eTPU), and/or polyether block amides (PEBA), such as plasticizer-free poly(ether-b-amide)s offered under the tradename Pebax® from Arkema of France. The midsole can relatively soft, compliant and elastic. In some cases, the midsole can be constructed from a first material having a first durometer of optionally less than 75 Shore D, less than 60 Shore D, less than 40 Shore D, less than 30 Shore D, less than 25 Shore D, between 25 Shore D and 50 Shore D, inclusive, between 25 Shore D and 40 Shore D, inclusive, or between 20 Shore D and 35 Shore D, inclusive. In some cases, the material can have a tear strength of optionally less than 170 kN/m, less than 150 kN/m, less than 125 kN/m, less than 100 kN/m, less than 75 kN/m, less than 50 kN/m, between 40 and 150 kN/m, inclusive, between 50 and 125 kN/m, inclusive, or between 60 and 100 kN/m.

The midsole 40 can include the midsole lower surface 30LS, which can also be referred to as a ground facing midsole lower surface. That surface can in come application be relatively flat, with the individual lugs bonded directly to that surface via molding of the midsole material to the individual lugs in a mold as described below. As shown in FIG. 3, however, the midsole lower surface 30LS can define multiple lug recesses 31. Each lug recess 31 can be defined in the midsole lower surface and can be bounded by a recess bottom 32 and a recess boundary edge 33. The recess boundary edge can transition to the midsole lower surface 30LS at a transition or corner 34. That transition can be an angled corner or a rounded smoothed transition. The recess bottom 32 can be bonded mechanically and chemically to the contact wall 42CW and/or base plate 42 at the interface 401. At that interface, the midsole material from which the midsole 30 is constructed can be chemically and mechanically bonded to the contact wall, as well as other parts of the base flange depending on the application.

Figure 4:
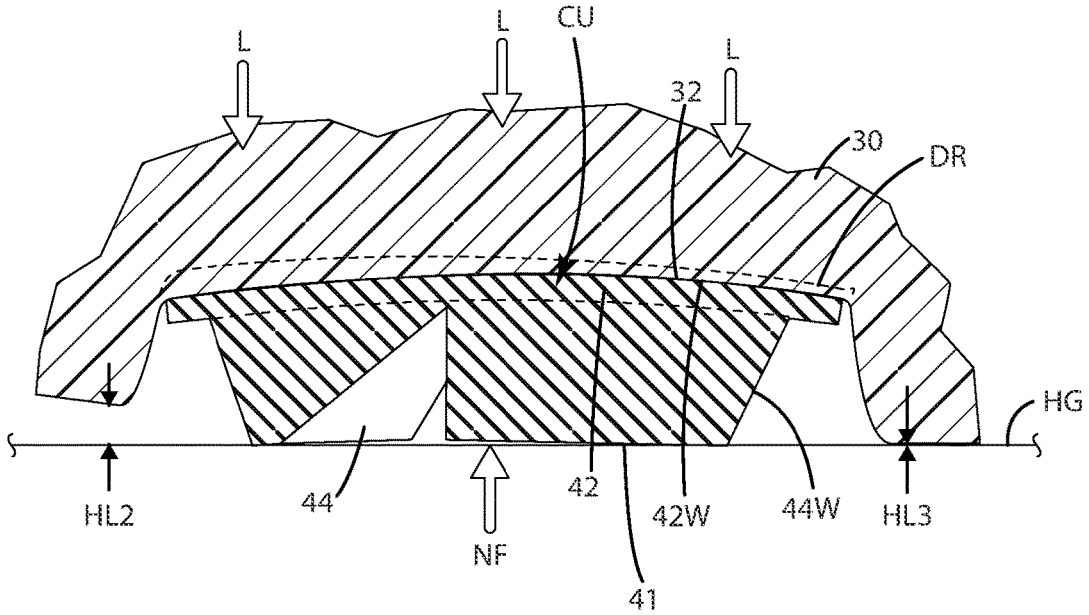
FIG. 4 is a section view of the lug and the midsole in a compressed hard traction mode.

The midsole 30 can include a deformation region DR above each lug recess. This deformation region can be a region that can be highly compressed or simply compressed more than an adjacent region AR of the midsole that is not above an individual lug 41 of the sole assembly. The deformation region can be of a volume sufficient to receive at least a portion of the lug when the lug retracts into the midsole as shown in FIG. 4 in a hard traction mode shown there. The deformation region DR can be of the same density and consistency of the other surrounding material of the midsole. It can, however, be locally compressed due to its proximity to the underlying individual lug. For example, when a user steps on the ground G, the weight of the user exerts a load L on the midsole and the individual lugs. The reactive normal force NF from the ground thus pushes the individual lug up and into a portion of the deformation region DR as shown in FIG. 4.

As mentioned above, the sole assembly 20 can include multiple, individual outsole lugs 40 disposed distal and independently from one another on the midsole lower surface 30L and/or in the respective lug recesses 31 as described above. The individual lugs 40 can be arranged as desired, and alternatively in a repeating pattern. The lugs can include one or more geometric shapes. The individual outsole lugs 40 can be constructed from one or more second materials, for example, natural or synthetic rubber, thermoplastic polyurethane elastomers, nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection. The second material can have a durometer that is greater than the first durometer of the first material of the midsole.

As shown in FIG. 3, each individual lug 41 can project outward from the respective recess 31. The outsole lug can include the base plate 42 and a lug body 44. The lug body 44 can include one or more lug walls 44W that transitions from the base plate downward to a lug ground contacting surface 45, which is configured to directly engage the terrain G under the lug when a load is placed on the sole assembly 20. The lug ground contacting surface can take on a variety of shapes depending on the desired traction characteristics of the sole assembly. As shown in FIG. 2, the surface 45 can be in the shape of chevrons, but of course, the shape can be other geometric shapes, such as ovals, circles, polygons, etc. The lug body can take on a similar shape as that surface, and the walls 44W can outline that shape. Optionally, the walls 40W can taper outwardly from the lug axis TA as the walls progress toward the midsole 30. Thus, the lug body can be thicker near the base plate than at the ground contacting surface 45.

The base plate 42 can include a lug perimeter flange 46 extending laterally outward from one or more of the lug walls 44W and including a flange lower surface 46U and a lug flange edge 47. The lug perimeter flange can extend outward laterally from each lug wall 40W by a distance DF that is optionally 0 mm to 5 mm, inclusive, 0.1 mm to 3 mm inclusive, or 0.1 mm to 2 mm inclusive. The base plate, perimeter flange and lug flange edge can each have a base height HB extending between the contact wall 42CW and the flange lower surface 46U. That base height HB can be less than, equal to or greater than the depth of the lug recess HR. Where the base height is less than the depth HR, the lower surface 46U is above the midsole lower surface 30LS. Where the base height is equal to the depth HR, the lower surface 46U is flush with the midsole lower surface 30LS. Where the base height is greater than the depth HR, the lower surface is below the midsole lower surface.

The base plate 42 and the recess can be oriented so there is a gap G1 around the flange edge 33. For example, the lug flange edge 33 can be adjacent and facing the recess boundary edge 33. Those elements, however, can be separated by a gap G1 between them around the lug and the base plate. Optionally, the gap can be optionally 0 mm to 2 mm, inclusive, 0.1 mm to 2 mm, inclusive, or 0.1 mm to 0.5 mm, inclusive, and can vary around the base plate.

Figure 11:
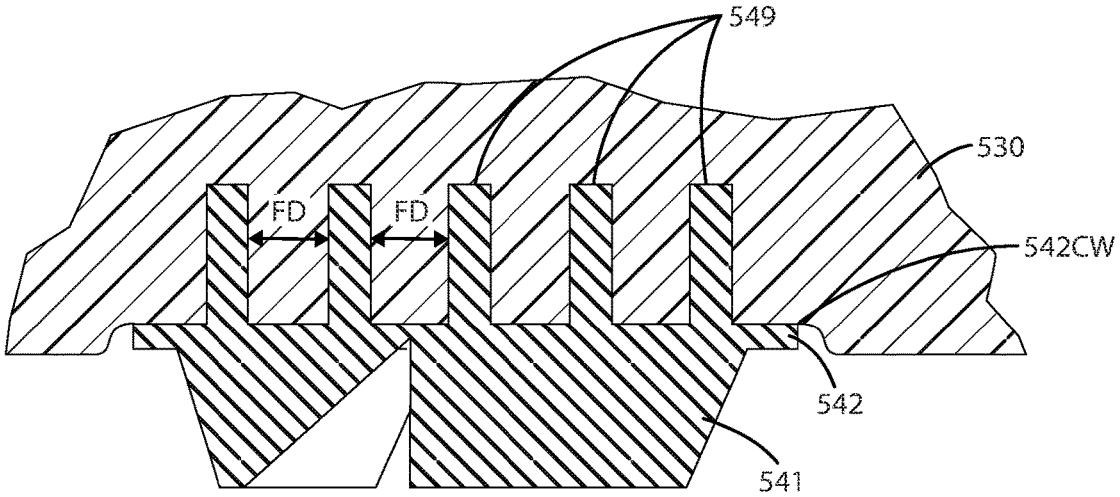
FIG. 11 is a section view of a lug and midsole of a fifth alternative embodiment with fins that enhance the joining of the lug to the midsole.

As mentioned above, the base plate can include a contact wall 42CW that is chemically and physically bonded to the recess bottom, below the deformation region DR. The contact wall 42CW can extend from the respective edges 47 on opposing sides of the base plate 42. The contact wall 42W can be smooth and planar as shown, or can have contours and/or projections extending up from it to enhance the mechanical bonding of the midsole material to it. For example, in an alternative embodiment, shown in FIG. 11, the lug 541 can include a contact wall 542CW that has multiple spaced fins 548 extending upward from the base plate 542. The fins can be spaced a distance FD from one another so that the midsole material of the midsole can enter and fill in the spaces between the fins 549. In turn, this can provide more surface area contact between the midsole and the fins of the lug. This also can provide more mechanical and chemical bonding between the midsole and the individual lug to impair the delamination of the lug from the midsole.

Returning to the embodiment in FIGS. 1-4, each individual lug can be disposed in respective ones of the lug recesses. Each individual lug 41 can project outward from the respective recess 31 and/or below the midsole lower surface 30LS a first distance or first lug height HL1 of optionally 0.1 mm to 20 mm, inclusive, 0.1 mm to 15 mm inclusive, 0.1 mm to 10 mm inclusive, 1 mm to 5 mm inclusive, or other distances respectively when the lugs are in an unloaded state, or in a soft traction mode, as shown in FIG. 3. This distance can be selected to adequately dig into soft underfoot terrain or some other ground surface depending on the application.

As shown in FIG. 4, the lugs can retract to a second projecting distance HL2 that is less than the first distance HL1 when the lugs are in a hard traction mode. In this hard traction mode, the lugs and sole assembly in general can contact a hard ground surface HG. When this occurs, the lug can individually retract upward into the deformation region DR of the midsole 30. As this occurs, the base plate optionally can bend upward, with the base plate 42 and/or the recess 31 and recess bottom 32 deforming in a convexly upward CU orientation as shown. Of course, depending on the shape and rigidity of the lug 41, those elements might not deform, and instead, might retain their shape as the lug is compressed upward into the deformation region DR of the midsole. In some cases, the perimeter flange in those cases might deform slightly, in a similar convexly upward configuration. When the lug is compressed upward, into the deformation region, the height of the lug can be reduced to HL2 or HL3, which again can be less than HL1. In some cases, where HL3 is 0 mm, the midsole lower surface HL3 contacts the underfoot terrain HG. This in turn can allow the midsole itself to provide some traction on the hard terrain HG. The lug can be in a hard traction mode when the height of the lug is reduced to HL2, HL3 or some other height that is less than HL1 when the lug is in the soft traction mode.

A method of making the footwear 10 and sole assembly 20 in particular will now be described. In general, the method can include placing in a mold multiple ones of the lugs 40, having the features of the lug 41 shown in FIG. 3. Before this placing in the mold, the individual lugs themselves can be molded with the various features and components. Individual lugs can be trimmed and shaped as desired to be used for further processing.

The individual lugs can be placed in the midsole mold according to their shape and assigned location. For example, different shaped and sized lugs can be placed in different locations depending on their intended function and traction capabilities. The midsole mold can be in the shape of the midsole and generally of a user's foot. The individual outsole lugs can be spaced apart in the configuration shown in FIG. 2, inside the mold, with a base plate facing upward into a mold cavity of the mold.

With all the individual lugs properly placed, the mold cavity can be closed and a midsole material, that is, the first material described above, can be introduced into the cavity, optionally under pressure, or by pour molding or some other means. The midsole material in its fluid form can bond to the contact wall 42CW and the edge 47 in some locations of each of the lugs.

With the midsole material having filled the mold cavity and engaged each of the individual lugs with spaces therebetween, the midsole material can be cured for a time. This curing allows the midsole material to form the midsole 30. That midsole can have the first durometer less than the second durometer of each of the plurality of lugs, the plurality of lugs being commonly joined with the midsole and one another. After the midsole is cured, the midsole with the lugs joined therewith can be removed from the mold. From there, the sole assembly can be cemented, glued or otherwise joined with the upper 17 as described above.

Figure 5:
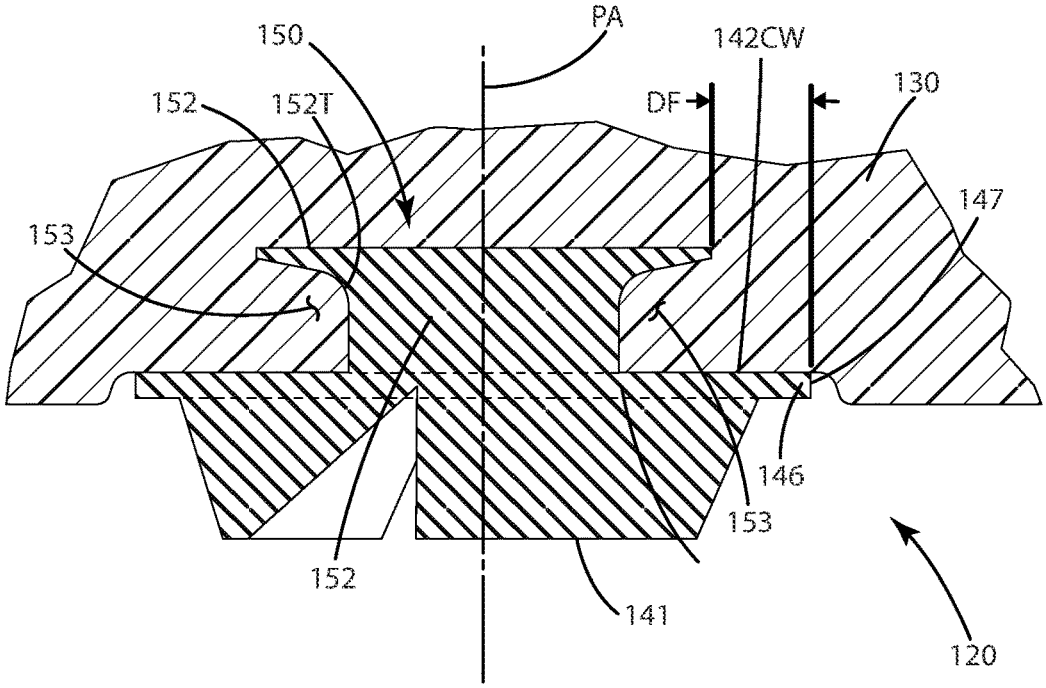
FIG. 5 is a section view of the lug and the midsole of a first alternative embodiment including a cap.

A first alternative embodiment of the sole assembly 120 and a particular lug 141 is shown in FIG. 5. That assembly and lug can be similar in structure, function and operation to the sole assembly, midsole and lug described above with several exceptions. For example, the lug can include a base plate having a contact wall 142CW. The lug, however, also can include a cap 150 projecting upward from the lug body and/or base plate 142. This cap 150 can include a post 152 extending upward from the base plate 142 into the midsole. The post can include a post axis PA. The cap can be joined with an upper end of the post, and can extend outwardly from the post axis PA so that a void 153 is formed between the cap and the base plate. This void can be continuous and can extend all the way around the cap 150 and/or post 152. In some cases, the void 153 can fill in the rounded transitions 152T between the cap and the post completely, to provide much surface contact between the midsole and the cap and lug. Generally, the first material that makes up the midsole is disposed in the void and mechanically interlocks with the cap so that the outsole lug is impaired from mechanical removal from the midsole, for example via delamination or tearing off of the individual lugs from the midsole.

As shown in FIG. 5, the cap 150 can extend radially outward from the post axis PA>. The cap can extend above the lug perimeter flange 146. The cap outermost boundary or edge 157 can be disposed inwardly a distance DF from the lug perimeter flange 146, and the outer flange edge 147 as shown. Optionally, in other constructions, the cap edge 157 can be even with the flange 147 or its edge, or can extend beyond those elements.

The method of making the sole assembly 110 of this construction is virtually identical to the method of making that of the embodiment above with several exceptions. For example, in the molding of the lugs, each of those lugs can be molded to include a cap that extends upward from the base plate, the cap and base plate forming a void therebetween. When those lugs are placed in the midsole mold cavity, the caps of individual lugs extend upward into the cavity. When the midsole material is introduced, it flows into each of the voids adjacent the caps and cures. In this way, the mechanical bond between the midsole and each of the lugs is enhanced. In this construction, like the one above, the base plate of each outsole lug can be distal from an adjacent base plate of an adjacent outsole lug, so that the midsole joins the base plates in a spaced part relationship upon curing.

Figure 6:
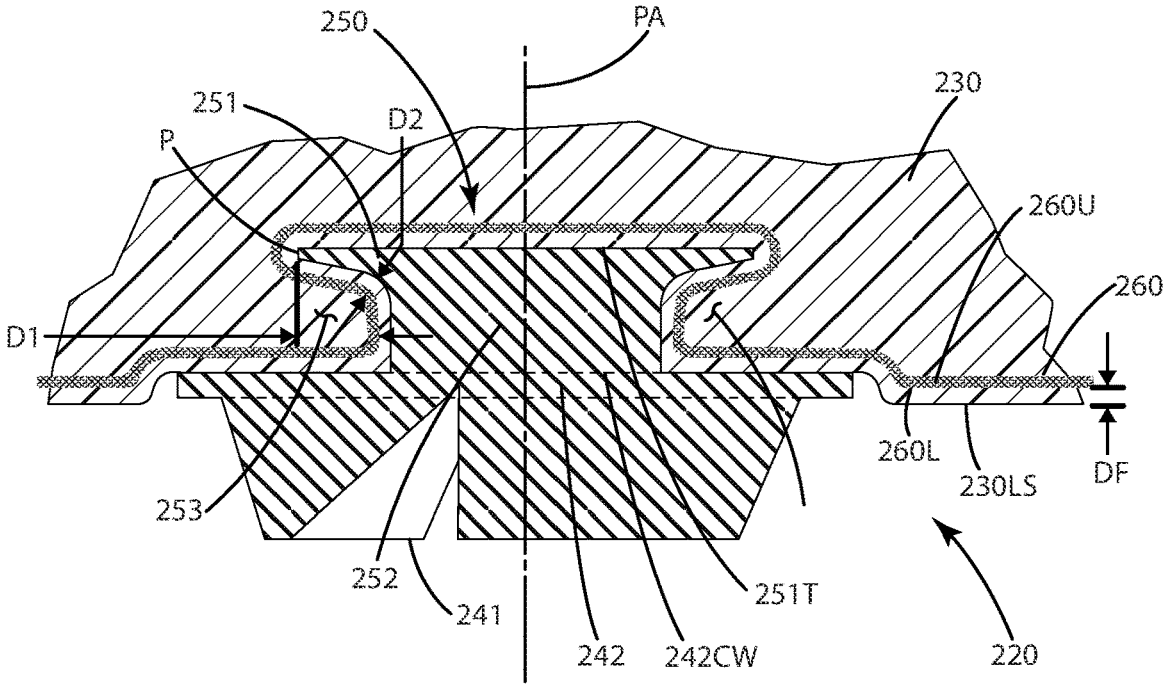
FIG. 6 is a section view of the lug and the midsole of a second alternative embodiment including a cap and a fabric embedded in the midsole for enhanced bonding of the lug to the midsole.

A second alternative embodiment of the sole assembly 220 and a particular lug 241 is shown in FIG. 6. That assembly and lug can be similar in structure, function and operation to the sole assembly, midsole and lug described above with several exceptions. For example, the lug 241 can include a base plate 242 having a contact wall 242CW. The lug also can include a cap 250 projecting upward from the lug body and/or base plate 242, with a void 253 between the cap and the base plate or lug in general. The construction, however, also can include a fabric 260. Fabric can be any textile material, and can be knitted, weaved, or loosely woven, or even nonwoven, depending on the application. The fabric 250 can including a plurality of adjacent strands with a plurality of interstitial spaces between the adjacent strands. The fabric can include an upper surface 260U and a lower surface 260L, which can be disposed on opposite sides of the fabric, generally facing up or facing down respectively when included in the sole assembly.

The fabric 260 as shown can be embedded and encapsulated in the midsole material 230. As shown, the fabric can be joined with the midsole so that the first material or midsole material extends through respective ones of the plurality of interstitial spaces. The midsole material can encapsulate respective ones of the plurality of adjacent strands coextensive with the midsole. The fabric can be embedded and concealed in the midsole, and not visible to a viewer of the midsole from a bottom view thereof. For example, the fabric 260 can extend adjacent the midsole lower surface 230LS, and can be disposed below that surface a sufficient distance DF so that the fabric is not visible in or at the lower surface. Optionally, in some cases where an aesthetic design is desired, that fabric can show though the lower surface so it is visible therein or thereon. The fabric 260 also can be disposed in the void 153 adjacent the cap 150. The fabric can further extend adjacent the base plate 243, and in particular the contact wall 242CW.

Further, the fabric can extend into the void 253 with the first material of the midsole. As an example, the fabric can extend into the void, inward from the outer perimeter plane P of the cap toward the post axis PA a distance D1, and can be folded or wrinkled near the post 252. The fabric optionally can contact the post or cap in the void. In some cases, the fabric can be located a distance D2 from the post or cap, so that the midsole material engages the cap or post rather than the fabric. This can enhance the connection of the lug to the midsole. The fabric and the first material in the void can provide additional mechanical bonding to secure the outsole lug to the midsole to prevent delamination of the outsole lug from the midsole.

The method of making the sole assembly 210 of this construction is virtually identical to the method of making that of the embodiments above with several exceptions. For example, in the molding of the lugs, each of those lugs can be molded to include a cap that extends upward from the base plate, the cap and base plate forming a void therebetween. When those lugs are placed in the midsole mold cavity, the caps of individual lugs extend upward into the cavity.

With the lugs and caps so placed in the mold, the fabric 260 can be placed over the lugs and caps. The fabric can lay against the contact wall 242CW, in the void 253 and on the top 251T of the cap. Optionally, the fabric can be stuffed into the voids 253 of the respective lugs. When the midsole material is introduced, it flows into each of the voids adjacent the caps. In so doing, it can push and urge the fabric farther into the voids the distance D1. The midsole material can also embed within the fabric and can encapsulate the respective strands, projecting through the interstitial spaces. When the midsole material cures, the mechanical bond between the midsole and each of the lugs can be enhanced with the additional cap and fabric bonding.

Figure 7:
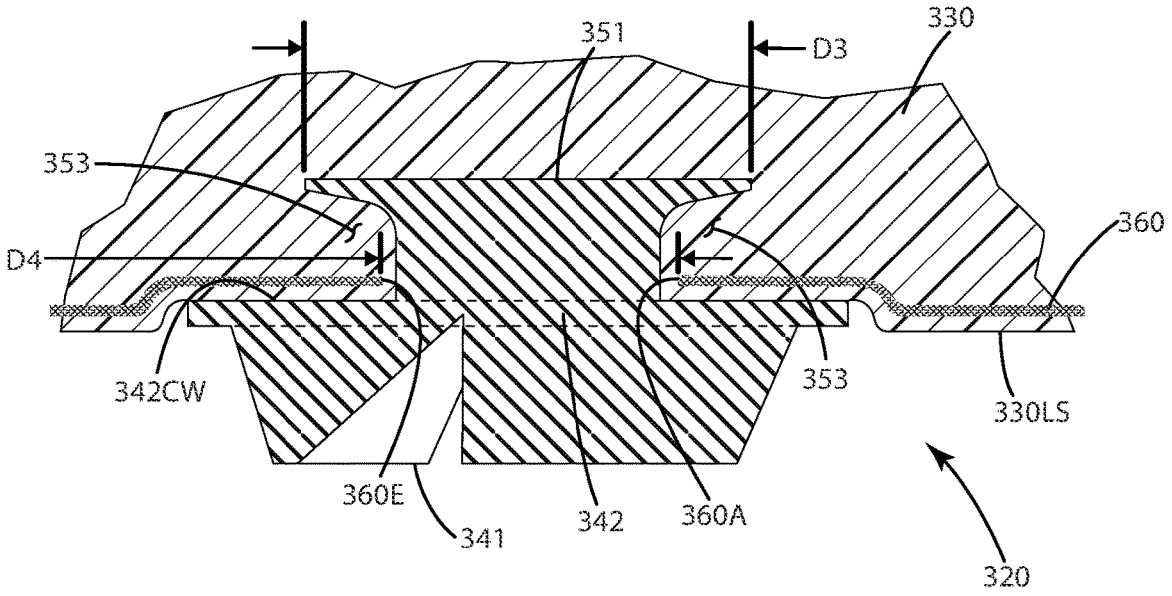
FIG. 7 is a section view of the lug and the midsole of a third alternative embodiment including a cap and a fabric having an aperture for the cap.
Figure 8:
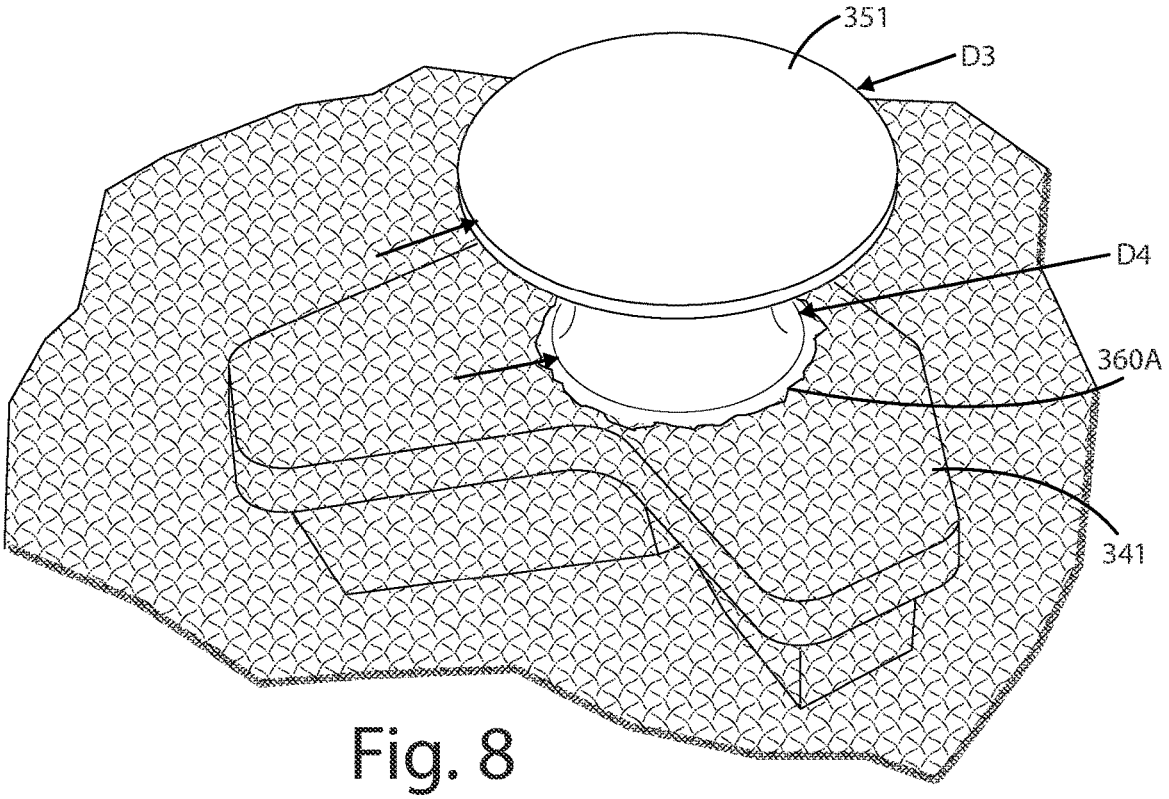
FIG. 8 is a perspective view of the fabric with the aperture applied to the lug before a midsole material is applied to the lug and fabric.

A third alternative embodiment of the sole assembly 320 and in particular lug 341 and fabric 360 is shown in FIGS. 7 and 8. That assembly and lug can be similar in structure, function and operation to the sole assembly, midsole and lug described above with several exceptions. For example, the lug 341 can include a base plate 342 having a contact wall 342CW, as well as a cap 351 with a void 353 defined between the cap and the base plate 342. The contact wall 342CW, however, can rest immediately adjacent the midsole lower surface 330LS. In this case, there is no lug recess in the midsole. The fabric 360 also can be configured to include a cap aperture 360A, through which the cap fits and extends. The cap aperture can be of a dimension D4 that is less than the dimension D3 of the cap, so that the edge 360E of the fabric fits in the void 353. The fabric can thus be placed consistently in the void, and excess wrinkling of the fabric around the cap can be avoided if desired for an application.

Figure 9:
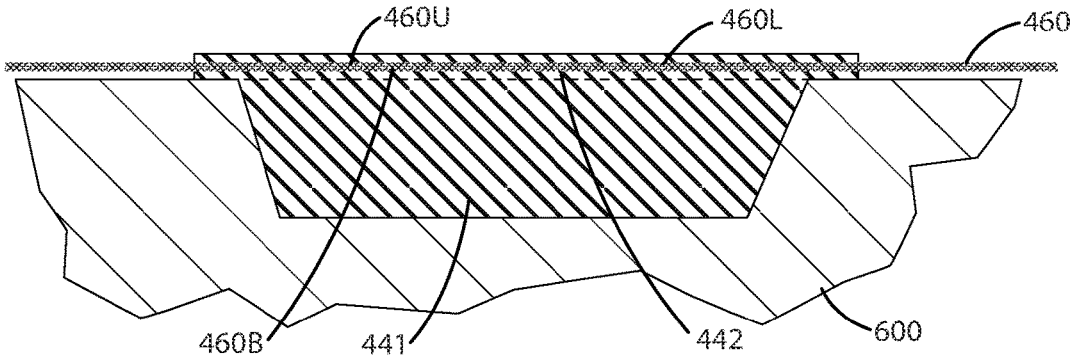
FIG. 9 is a section view of a lug of a fourth alternative embodiment with a fabric being molded to the lug before the fabric and lug are joined with a midsole.
Figure 10:
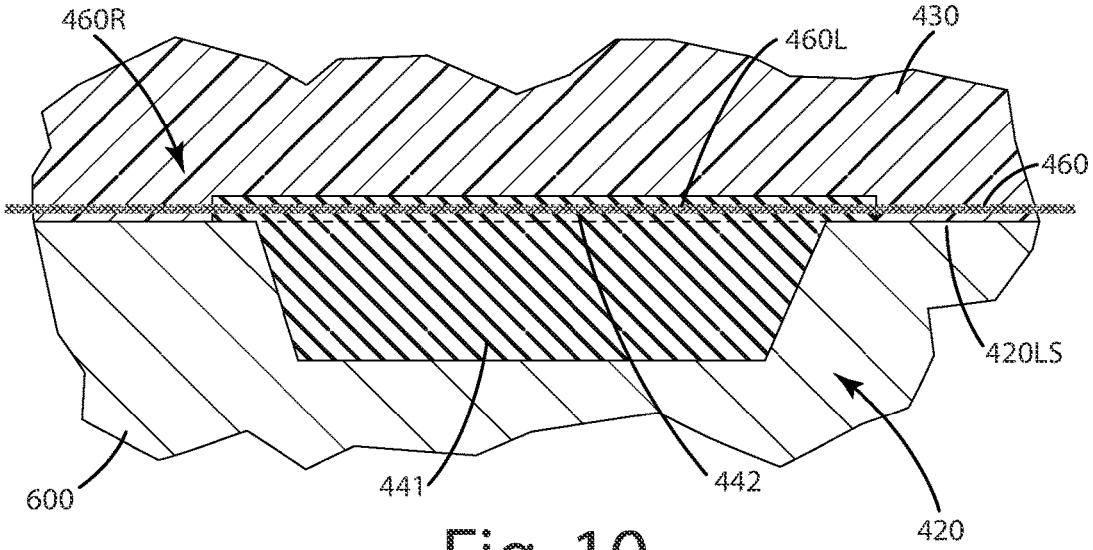
FIG. 10 is a section view of the lug and fabric thereof being joined with a midsole material.

A fourth alternative embodiment of the sole assembly 420 and a particular lug 441 and fabric 460 is shown in FIGS. 9 and 10. That assembly and lug can be similar in structure, function and operation to the sole assembly, midsole and lug described above with several exceptions. For example, the lug 441 can include a base plate 442 having a contact wall 442CW. In this construction, however, a fabric 460 can be embedded and encapsulated in the lug itself, in the second material from which the lug is constructed. The fabric can include a lug region 460L that is embedded in and encapsulated in the lug, for example, in the base plate 442 of the lug 441. The fabric 460 also can be embedded in and encapsulated in the midsole material 430 in a manner similar to that of the embodiments above, and optionally being spaced from the midsole lower surface 420LS so that it is concealed in that midsole.

The method of making the sole assembly 410 of this construction is virtually identical to the method of making that of the embodiments above with several exceptions. For example, in the molding of the lugs, each of those lugs can be molded with a second material of the lug to include its various features. Before this molding, however, the fabric 460 can be placed in the mold 500 as shown in FIG. 9. The second material can be introduced into the mold so that the second material extends through respective ones of the interstitial spaces of the lug portion 460L of the fabric. The second material also can encapsulate respective ones of the adjacent strands coextensive with the outsole lug. The fabric can include an upper surface 460U and a lower surface 460B. The fabric can extend within the base plate 442. The second material can be disposed above the upper surface and below the lower surface upon the molding of the second material in the mold 500.

With the outsole lugs molded to the fabric, the lugs and the fabric can be placed in another mold 600 as shown in FIG. 10. The mold can be closed and the midsole material 430 can be introduced into the mold cavity. The midsole material can encapsulate the fabric during the introducing step so that the midsole material bonds with the fabric and the lugs to enhance the securement of the lugs to the midsole. In so doing the midsole material contacts and bonds with the base plate 442, but not the fabric region 460L. The midsole material also encapsulates and embeds in the remainder 460R of the fabric that is not within the lugs. After the midsole material cures, the sole assembly, with the lugs well secured to the midsole via the fabric, can be removed for further assembly of the footwear.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

The embodiments of the invention in which an exclusive property or privilege is claimed are defined as follows:

1. A footwear construction comprising:

a midsole constructed from a first material having a first durometer, the midsole including a midsole upper surface, a ground facing midsole lower surface, and a plurality of lug recesses, each lug recess defined in the midsole lower surface and bounded by a recess bottom and a recess boundary edge, the midsole including a deformation region above each lug recess; and a plurality of outsole lugs disposed in respective ones of the plurality of lug recesses, each outsole lug constructed from a second material, different from the first material, and having a second durometer greater than the first durometer, the outsole lug projecting outward from the respective recess, the outsole lug comprising:

a base plate;

a post extending upward from the base plate into the midsole;

a cap formed with an upper end of the post so that a void is formed between the cap and the base plate; and a lug body, the lug body including a lug wall that transitions from the base plate downward to a lowermost surface of the lug, the base plate including a lug perimeter flange extending laterally outward from the lug wall and including a flange lower surface and a lug flange edge, the lug flange edge being adjacent and facing the recess boundary edge, the base plate including a contact wall that is bonded to the recess bottom, below the deformation region;

wherein the outsole lug is operable in a soft traction mode in which the lug extends below the midsole lower surface a first distance between 0.1 mm and 15 mm, and a hard traction mode, in which the lug compresses upward into the deformation region of the midsole so that the outsole lug extends below the midsole lower surface a second distance less than the first distance, and so that at least a portion of the midsole lower surface is a midsole ground contacting surface, wherein the cap includes a cap outermost edge above the void, wherein the cap includes a cap upper surface above the cap outermost edge, wherein the first material of the first durometer is bonded directly to the cap upper surface and the cap outermost edge, and is disposed in the void below the cap outermost edge, wherein the outsole lug is molded and forms a single-piece lug including the base plate, the post, the cap, and the lug body, such that the base plate, the post, the cap, and the lug body are commonly constructed from the second material having the second durometer, wherein the flange lower surface is at least one of above the midsole lower surface and flush with the midsole lower surface, wherein the second distance is such that the midsole lower surface and the lowermost surface of the lug simultaneously contact an underfoot terrain in the hard traction mode to provide a combined ground contact surface having a greater surface area than that of the lug alone, whereby traction on the underfoot terrain is enhanced.

2. The footwear construction of claim 1, wherein the post includes a post axis, wherein the cap extends radially outwardly from the post axis so that the void is formed between the cap and the base plate.

3. The footwear construction of claim 2, wherein the first material mechanically interlocks with the cap so that the outsole lug is impaired from mechanical removal from the midsole.

4. The footwear construction of claim 1, wherein the cap extends above the lug perimeter flange, wherein the cap includes a cap outermost edge that extends outwardly from a post axis, wherein the cap outermost edge is disposed inwardly a distance from the lug perimeter flange, closer to the post axis than the lug perimeter flange.

5. The footwear construction of claim 1 comprising:

a fabric embedded and encapsulated in the outsole lug and in the midsole, the fabric being concealed in the outsole lug and the midsole, the fabric providing additional mechanical bonding to secure the outsole lug to the midsole to prevent delamination of the outsole lug from the midsole.

6. The footwear construction of claim 1 comprising:

a fabric disposed in the void adjacent the cap and extending adjacent the base plate and adjacent the midsole lower surface, wherein the fabric is embedded and encapsulated in the first material of the midsole, wherein the first material of the midsole extends into the void;

wherein the fabric and the first material in the void provide additional mechanical bonding to secure the outsole lug to the midsole to prevent delamination of the outsole lug from the midsole.

7. The footwear construction of claim 1 comprising:

a fabric including a plurality of adjacent strands with a plurality of interstitial spaces between the adjacent strands, wherein the fabric is joined with the outsole lug so that the second material extends through respective ones of the plurality of interstitial spaces, the second material encapsulating respective ones of the plurality of adjacent strands coextensive with the outsole lug, wherein the fabric is joined with the midsole so that the first material extends through respective ones of the plurality of interstitial spaces, the first material encapsulating respective ones of the plurality of adjacent strands coextensive with the midsole.

8. The footwear construction of claim 7, wherein the fabric is embedded and concealed in the outsole lug and the midsole, and not visible to a viewer of the midsole from a bottom view thereof.

9. A footwear construction comprising:

a midsole constructed from a first material having a first durometer, the midsole including a midsole upper surface, a ground facing midsole lower surface, and a plurality of lug recesses, each lug recess defined in the midsole lower surface and bounded by a recess bottom and a recess boundary edge, the midsole including a deformation region above each lug recess; and a plurality of outsole lugs disposed in respective ones of the plurality of lug recesses, each outsole lug constructed from a second material different from the first material and having a second durometer greater than the first durometer, the outsole lug projecting outward from the respective recess, the outsole lug including a base plate and a lug body, the lug body including a lug wall that transitions from the base plate downward to a lowermost surface of the lug, the base plate including a lug perimeter flange extending laterally outward from the lug wall and including a flange lower surface and a lug flange edge, the base plate being bonded to the recess bottom, below the deformation region;

a post extending upward from the base plate into the midsole; and a cap joined with an upper end of the post so that a void is formed between the cap and the base plate, the cap including a cap outermost edge that transitions to a cap upper surface, wherein the outsole lug is operable in a soft traction mode in which the lug extends below the midsole lower surface a first distance and a hard traction mode, in which the lug compresses upward into the deformation region of the midsole so that the outsole lug extends below the midsole lower surface a second distance less than the first distance, wherein the first material of the first durometer extends into the void and is bonded directly to the cap upper surface and the cap outermost edge;

wherein the entire flange lower surface is at least one of above the midsole lower surface and flush with the midsole lower surface, wherein in the hard traction mode, the midsole lower surface and the lowermost surface of the lug simultaneously contact an underfoot terrain to provide a combined ground contact surface having a greater surface area than that of the lug alone, whereby traction on the underfoot terrain is enhanced.

10. The footwear construction of claim 9, wherein the lug flange edge is spaced by a gap from the recess boundary edge.

11. The footwear construction of claim 10, wherein the first material of the midsole extends into and fills the void;

wherein the first material in the void provides mechanical bonding to secure the outsole lug to the midsole, whereby delamination of the plurality of outsole lugs from the midsole is impaired.

12. The footwear construction of claim 9, wherein the outsole lug in the soft traction mode extends below the midsole lower surface a first distance of 0.1 mm to 15 mm inclusive, wherein the outsole lug compresses upward into the deformation region of the midsole in the hard traction mode so that the outsole lug extends below the midsole lower surface a second distance less than the first distance, wherein the base plate bends upward in the hard traction mode, with the recess deforming convexly upward.

13. The footwear construction of claim 9, wherein the first durometer is less than 50 Shore D, wherein the second durometer is greater than the first durometer.

14. The footwear construction of claim 9 comprising:

a fabric substrate extending through and embedded within the outsole lug and the second material, wherein the fabric substrate extends away from the outsole lug and is embedded within the midsole and the first material, adjacent the midsole lower surface, wherein the fabric substrate is initially embedded in the first and second materials in different molds.

15. A footwear construction comprising:

a midsole constructed from a first material having a first durometer, the midsole including a midsole upper surface, a ground facing midsole lower surface, and a plurality of lug recesses, each lug recess defined in the midsole lower surface and bounded by a recess bottom and a recess boundary edge, the midsole including a deformation region above each lug recess;

a plurality of outsole lugs disposed in respective ones of the plurality of lug recesses, each outsole lug constructed from a second material different from the first material and having a second durometer greater than the first durometer, the outsole lug projecting outward from the respective recess, the outsole lug including a base plate and a lug body, the lug body including a lug wall that transitions from the base plate downward to a lowermost surface of the lug, the base plate being bonded to the recess bottom, below the deformation region;

a post extending upward from the base plate into the midsole; and a cap extending outward from the post so that a void is formed between the cap and the base plate, wherein the cap includes a cap outermost edge above the void, wherein the cap includes a cap upper surface above the cap outermost edge, wherein the first material of the first durometer is bonded directly to the cap upper surface, and fills in the void below the cap outermost edge, wherein the outsole lug is operable in a soft traction mode in which the lug extends below the midsole lower surface a first distance and a hard traction mode, in which the lug compresses upward into the deformation region of the midsole so that the outsole lug extends below the midsole lower surface a second distance less than the first distance, and wherein in the hard traction mode, the midsole lower surface and the lowermost surface of the lug simultaneously contact an underfoot terrain to provide a combined ground contact surface having a greater surface area than that of the lug alone, whereby traction on the underfoot terrain is enhanced.

16. The footwear construction of claim 1, wherein the post is a fixed length between the cap and the base plate.

17. The footwear construction of claim 1, wherein the lug perimeter flange includes a flange upper surface extending from the edge toward the post, wherein the flange upper surface is planar, wherein the flange lower surface is planar.

18. The footwear construction of claim 1, wherein the lug body includes a plurality of additional lug walls, wherein each additional lug wall tapers toward a respective lug axis as each additional lug wall extends from the flange lower surface to the lowermost surface of the lug, wherein each additional lug wall forms a polygonal surface.

* * * * *